US009634385B2

(12) United States Patent
Feng et al.

(10) Patent No.: US 9,634,385 B2
(45) Date of Patent: Apr. 25, 2017

(54) ANTENNA APPARATUS AND TERMINAL DEVICE

(71) Applicant: Huawei Device Co., Ltd., Shenzhen (CN)

(72) Inventors: Chao Feng, Beijing (CN); Tiezhu Liang, Beijing (CN)

(73) Assignee: Huawei Device Co., Ltd., Shenzhen (CN)

( * ) Notice: Subject to any disclaimer, the term of this patent is extended or adjusted under 35 U.S.C. 154(b) by 0 days.

(21) Appl. No.: 14/816,190

(22) Filed: Aug. 3, 2015

(65) Prior Publication Data

US 2015/0340761 A1 Nov. 26, 2015

Related U.S. Application Data

(63) Continuation of application No. PCT/CN2014/071740, filed on Jan. 29, 2014.

(30) Foreign Application Priority Data

Feb. 4, 2013 (CN) ..... 2013 1 0043758

(51) Int. Cl.
*H01Q 1/38* (2006.01)
*H01Q 7/00* (2006.01)
(Continued)

(52) U.S. Cl.
CPC ..... *H01Q 1/38* (2013.01); *H01Q 1/243* (2013.01); *H01Q 5/371* (2015.01); *H01Q 7/00* (2013.01);
(Continued)

(58) Field of Classification Search
CPC ..... H01Q 1/38; H01Q 9/0421; H01Q 5/371; H01Q 1/243; H01Q 9/0442; H01Q 7/00; H01Q 9/42
See application file for complete search history.

(56) References Cited

U.S. PATENT DOCUMENTS 8,217,841 B2 7/2012 Hossain et al.
2003/0151555 A1 8/2003 Holshouser
(Continued)

FOREIGN PATENT DOCUMENTS

CN 101496224 A 7/2009
CN 101809813 A 8/2010
(Continued)

OTHER PUBLICATIONS

Partial English Translation and Abstract of Chinese Patent Application No. CN102403568, Nov. 9, 2015, 4 pages.
(Continued)

*Primary Examiner* — Hoang Nguyen
*Assistant Examiner* — Michael Bouizza
(74) *Attorney, Agent, or Firm* — Quarles & Brady LLP

(57) ABSTRACT

An antenna apparatus and a terminal device are provided, which relate to the field of communications technologies. A switch disposed at an end of an antenna arm controls an antenna to switch to different resonance frequencies, therefore reduced antenna efficiency caused by switch loss is avoided and space occupied by the antenna is not increased. The antenna apparatus includes an antenna and a printed circuit board, where a feedpoint and a first grounding point are disposed on the printed circuit board, the antenna is connected to the feedpoint, and the antenna includes a first arm.

12 Claims, 4 Drawing Sheets

(51) Int. Cl.

| | |
|---|---|
| ***H01Q 9/42*** | (2006.01) |
| ***H01Q 1/24*** | (2006.01) |
| ***H01Q 9/04*** | (2006.01) |
| ***H01Q 5/371*** | (2015.01) |

(52) U.S. Cl.
CPC ..... *H01Q 9/0421* (2013.01); *H01Q 9/0442* (2013.01); *H01Q 9/42* (2013.01)

(56) References Cited

U.S. PATENT DOCUMENTS

| | | | | |
|---|---|---|---|---|
| 2009/0128428 | A1 | 5/2009 | Ishizuka et al. | |
| 2009/0251383 | A1 | 10/2009 | Tani et al. | |
| 2011/0102290 | A1 | 5/2011 | Milosavljevic | |
| 2011/0275333 | A1 | 11/2011 | Kim et al. | |
| 2013/0241798 | A1* | 9/2013 | Lee ..... | H01Q 9/42 343/876 |

FOREIGN PATENT DOCUMENTS

| | | | |
|---|---|---|---|
| CN | 102157801 | A | 8/2011 |
| CN | 102280689 | A | 12/2011 |
| CN | 102403568 | A | 4/2012 |
| CN | 102723585 | A | 10/2012 |
| EP | 1502322 | B1 | 6/2006 |
| EP | 2387105 | A2 | 11/2011 |
| JP | 2006180077 | A | 7/2006 |
| KR | 100924769 | B1 | 11/2009 |
| WO | 2013007868 | A1 | 1/2013 |

OTHER PUBLICATIONS

Partial English Translation and Abstract of Chinese Patent Application No. CN102157801, Jul. 31, 2015, 3 pages.

Partial English Translation and Abstract of Japanese Patent Application No. JP2006180077, Oct. 19, 2015, 31 pages.

Foreign Communication From A Counterpart Application, Chinese Application No. 201310043758.9, Chinese Office Action dated Sep. 6, 2015, 9 pages.

Foreign Communication From A Counterpart Application, PCT Application No. PCT/CN2014/071740, English Translation of International Search Report dated May 5, 2014, 2 pages.

Foreign Communication From A Counterpart Application, PCT Application No. PCT/CN2014/071740, English Translation of Written Opinion dated May 5, 2014, 7 pages.

Mak, et al. "Reconfigurable Multiband Antenna Designs for Wireless Communication Devices," IEEE Transactions on Antennas and Propogation, vol. 55, No. 7, Jul. 2007, pp. 1919-1928.

Foreign Communication From A Counterpart Application, European Application No. 14745766.7, Extended European Search Report dated Dec. 23, 2015, 10 pages.

* cited by examiner

ANTENNA APPARATUS AND TERMINAL DEVICE

CROSS-REFERENCE TO RELATED APPLICATION

This application is a continuation of International Application No. PCT/CN2014/071740, filed on Jan. 29, 2014, which claims priority to Chinese Patent Application No. 201310043758.9, filed on Feb. 4, 2013, both of which are hereby incorporated by reference in their entireties.

TECHNICAL FIELD

The present disclosure relates to the field of communications technologies, and in particular, to an antenna apparatus and a terminal device.

BACKGROUND

With the development of communications technologies, most terminal devices such as mobile phones require multi-frequency coexistence. For example, introduction of a Long Term Evolution (LTE) frequency range requires increasingly large bandwidth of an antenna, and a common antenna cannot meet a requirement for antenna bandwidth in limited space. Therefore, a switch needs to be used to control the antenna to switch to different resonance frequencies, so as to increase bandwidth of the antenna.

However, a current switch is disposed in the middle of an antenna circuit, which generates switch loss, causing reduced antenna efficiency; however, using a common antenna without a switch so as not to reduce the antenna efficiency increases space occupied by the antenna.

SUMMARY

The present disclosure provides an antenna apparatus and a terminal device. A switch disposed at an end of an antenna arm controls an antenna to switch to different resonance frequencies; therefore reduced antenna efficiency caused by switch loss is avoided and space occupied by the antenna is not increased.

To resolve the foregoing technical problem, the present disclosure uses the following technical solutions According to one aspect, the present disclosure provides an antenna apparatus, including an antenna and a printed circuit board, where a feedpoint and a first grounding point are disposed on the printed circuit board; the antenna is connected to the feedpoint, and the antenna includes a first arm; and the antenna apparatus further includes a first switch, where an end of the first arm is connected to the first grounding point by the first switch, where when the first switch is closed, the end of the first arm is connected to the first grounding point, and when the first switch is opened, the end of the first arm is floating.

Further, the antenna includes a second arm, and an end of the second arm is grounded.

Further, the antenna includes a third arm, and an end of the third arm is floating.

Further, the antenna apparatus further includes a second switch and a second grounding point that is disposed on the printed circuit board; where the antenna further includes a second arm, an end of the second arm is connected to the second grounding point by the second switch, when the second switch is closed, the end of the second arm is connected to the second grounding point, and when the second switch is opened, the end of the second arm is floating.

Further, the antenna includes a third arm, and an end of the third arm is floating.

According to another aspect, the present disclosure further provides a terminal device, including the foregoing antenna apparatus, a radio frequency module connected to a feedpoint on a printed circuit board in the antenna apparatus, and a switch control module connected to a first switch or a first switch and a second switch in the antenna apparatus.

Further, the terminal device is a mobile phone, a data card, a fixed wireless terminal, or a tablet computer.

According to the antenna apparatus and the terminal device in embodiments of the present disclosure, a switch disposed at an end of an antenna arm controls whether the end of the antenna arm is grounded, so that an antenna switches to different resonance frequencies. The switch is disposed at the end of the antenna arm, and switch loss is not caused; therefore, antenna bandwidth is increased while reduced antenna efficiency caused by the switch loss is avoided, and space occupied by the antenna is not increased.

BRIEF DESCRIPTION OF DRAWINGS

To describe the technical solutions in the embodiments of the present disclosure more clearly, the following briefly introduces the accompanying drawings required for describing the embodiments. The accompanying drawings in the following description show merely some embodiments of the present disclosure, and a person of ordinary skill in the art may still derive other drawings from these accompanying drawings without creative efforts.

DESCRIPTION OF EMBODIMENTS

The following clearly describes the technical solutions in the embodiments of the present disclosure with reference to the accompanying drawings in the embodiments of the present disclosure. The described embodiments are merely some but not all of the embodiments of the present disclosure. All other embodiments obtained by a person of ordinary skill in the art based on the embodiments of the present disclosure without creative efforts shall fall within the protection scope of the present disclosure.

Embodiment 1

Figure 1:
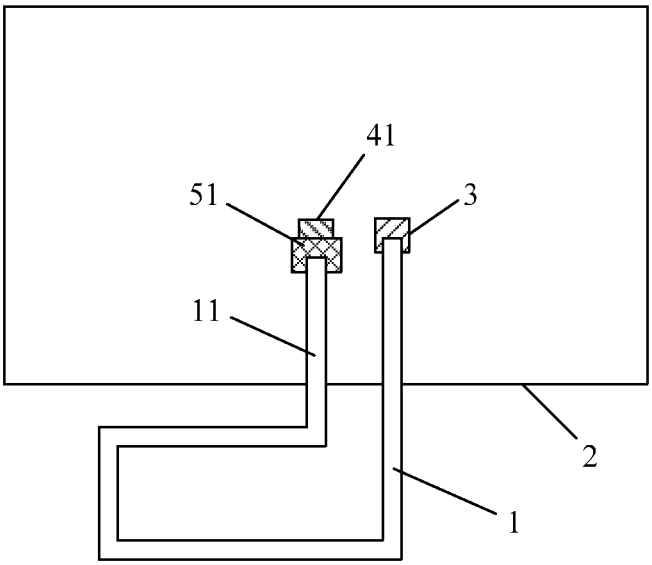
FIG. 1 is a schematic structural diagram of an antenna apparatus according to an embodiment of the present disclosure.

As shown in FIG. 1, Embodiment 1 of the present disclosure provides an antenna apparatus, which includes an antenna 1 and a printed circuit board 2, where a feedpoint 3 and a first grounding point 41 are disposed on the printed circuit board 2; the antenna 1 is connected to the feedpoint 3; the printed circuit board 2 implements signal transmission with the antenna 1 using the feedpoint 3; the antenna 1 includes a first arm 11. The antenna apparatus further includes a first switch 51, where an end of the first arm 11 is connected to the first grounding point 41 by the first switch 51; when the first switch 51 is closed, the end of the first arm 11 is connected to the first grounding point 41, so that the first arm 11 forms a loop arm, and in this case, the antenna is equivalent to a loop (Loop) antenna, and the end of the first arm 11 is a grounding point of the Loop antenna; when the switch 51 is opened, the end of the first arm 11 is floating, and therefore, the antenna in this case is equivalent to a monopole (Monopole) antenna, and the end of the first arm 11 is an end of the Monopole antenna.

Closing and opening of the first switch 51 may enable the end of the first arm 11 of the antenna to switch between a grounded state and a disconnected state and enable the antenna to switch between the Loop antenna and the Monopole antenna. The first arm 11 generates different resonance frequencies in the grounded state and the floating state, thereby changing a resonance frequency of the antenna and increasing antenna bandwidth.

According to the antenna apparatus in this embodiment of the present disclosure, a switch disposed at an end of an antenna arm controls whether the end of the antenna arm is grounded, so that an antenna switches to different resonance frequencies. The switch is disposed at the end of the antenna arm, and switch loss is not caused; therefore, antenna bandwidth is increased while reduced antenna efficiency caused by the switch loss is avoided, and space occupied by the antenna is not increased.

Embodiment 2

Figure 2:
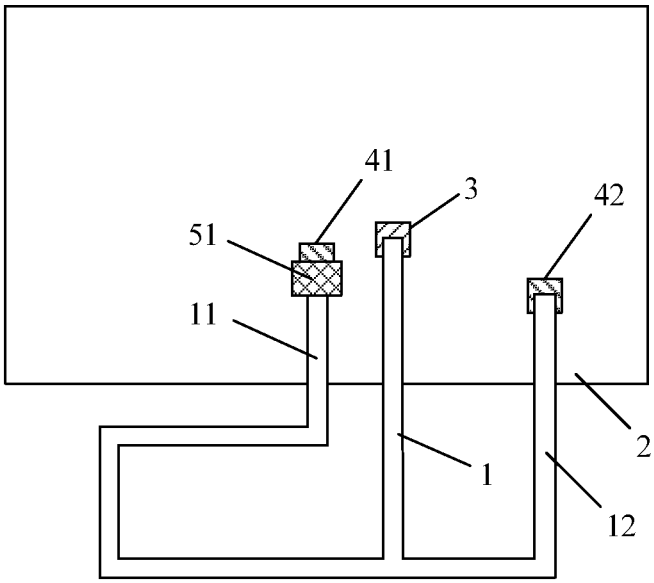
FIG. 2 is a schematic structural diagram of another antenna apparatus according to an embodiment of the present disclosure.

As shown in FIG. 2, Embodiment 2 is based on Embodiment 1, and the antenna 1 further includes a second arm 12, where an end of the second arm 12 is grounded. That is, the second arm 12 is connected to the printed circuit board 2 by a second grounding point 42 on the printed circuit board 2, so that the second arm 12 forms a loop arm. Other structures in the antenna apparatus are the same as those in Embodiment 1, and details are not described herein again.

When the first switch 51 is closed, the end of the first arm 11 is connected to the first grounding point 41; in this case, the antenna is equivalent to a double Loop antenna, and the end of the first arm 11 is a grounding point of the double Loop antenna. When the first switch 51 is opened, the end of the first arm 11 is floating; therefore, the antenna in this case is equivalent to a single-arm planar inverted-F antenna (PIFA), and the end of the first arm 11 is an end of the single-arm PIFA antenna. Closing and opening of the first switch 51 enable the antenna to switch between the double Loop antenna and the single-arm PIFA antenna, and the first arm 11 generates different resonance frequencies in the grounded state and the floating state, thereby changing a resonance frequency of the antenna and increasing antenna bandwidth.

According to the antenna apparatus in this embodiment of the present disclosure, a switch disposed at an end of an antenna arm controls whether the end of the antenna arm is grounded, so that an antenna switches to different resonance frequencies. The switch is disposed at the end of the antenna arm, and switch loss is not caused; therefore, antenna bandwidth is increased while reduced antenna efficiency caused by the switch loss is avoided, and space occupied by the antenna is not increased.

Embodiment 3

Figure 3:
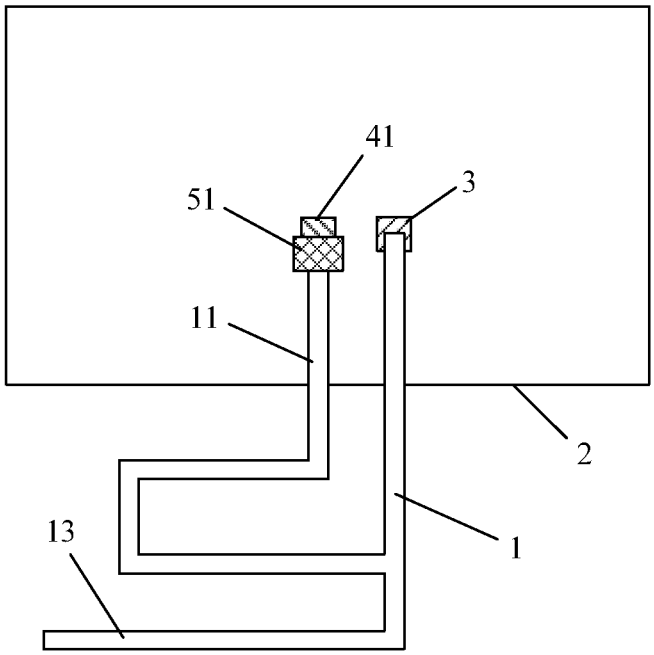
FIG. 3 is a schematic structural diagram of another antenna apparatus according to an embodiment of the present disclosure.

As shown in FIG. 3, Embodiment 3 is based on Embodiment 1, and the antenna 1 further includes a third arm 13, where an end of the third arm 13 is floating. Other structures in the antenna apparatus are the same as those in Embodiment 1, and details are not described herein again.

When the first switch 51 is closed, the end of the first arm 11 is connected to the first grounding point 41; in this case, the antenna is equivalent to a Loop+high-frequency arm antenna, and the end of the first arm 11 is a grounding point of the antenna. When the first switch 51 is opened, the end of the first arm 11 is floating; therefore, the antenna in this case is equivalent to a Monopole antenna, and the end of the first arm 11 is an end of the Monopole antenna. Closing and opening of the first switch 51 enable the antenna to switch between the Loop+high-frequency arm antenna and the Monopole antenna. The first arm 11 generates different resonance frequencies in the grounded state and the floating state, thereby changing a resonance frequency of the antenna and increasing antenna bandwidth.

According to the antenna apparatus in this embodiment of the present disclosure, a switch disposed at an end of an antenna arm controls whether the end of the antenna arm is grounded, so that an antenna switches to different resonance frequencies. The switch is disposed at the end of the antenna arm, and switch loss is not caused; therefore, antenna bandwidth is increased while reduced antenna efficiency caused by the switch loss is avoided, and space occupied by the antenna is not increased.

Embodiment 4

Figure 4:
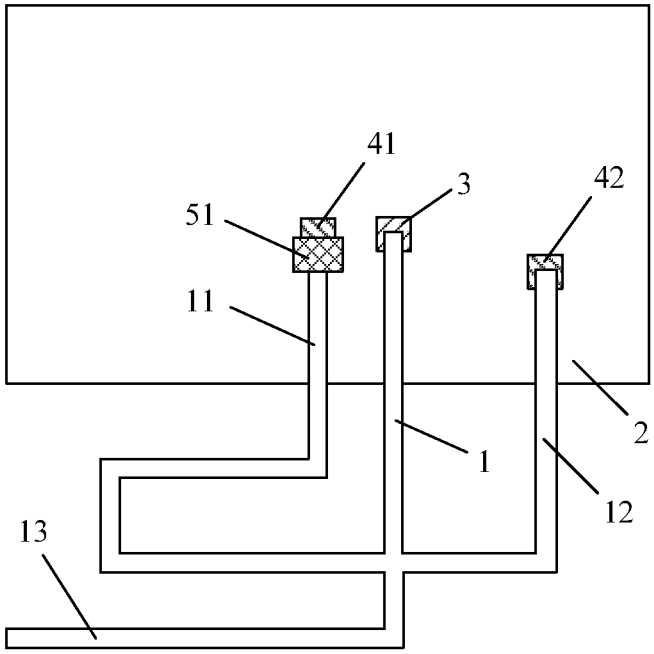
FIG. 4 is a schematic structural diagram of another antenna apparatus according to an embodiment of the present disclosure.

As shown in FIG. 4, Embodiment 4 is based on Embodiment 2, and the antenna 1 further includes a third arm 13, where an end of the third arm 13 is floating. Other structures in the antenna apparatus are the same as those in Embodiment 2, and details are not described herein again.

When the first switch 51 is closed, the end of the first arm 11 is connected to the first grounding point 41; in this case, the antenna is equivalent to a double Loop+high-frequency arm antenna, and the end of the first arm 11 is a grounding point of the double Loop antenna+high-frequency arm antenna. When the first switch 51 is opened, the end of the first arm 11 is floating; therefore, the antenna in this case is equivalent to a double-arm PIFA antenna, and the end of the first arm 11 is an end of the double-arm PIFA antenna. Closing and opening of the first switch 51 enable the antenna to switch between the double Loop+high-frequency arm antenna and the double-arm PIFA antenna, which changes a resonance frequency of the first arm 11, and simultaneously changes a resonance frequency of the antenna and increases antenna bandwidth.

Figure 5:
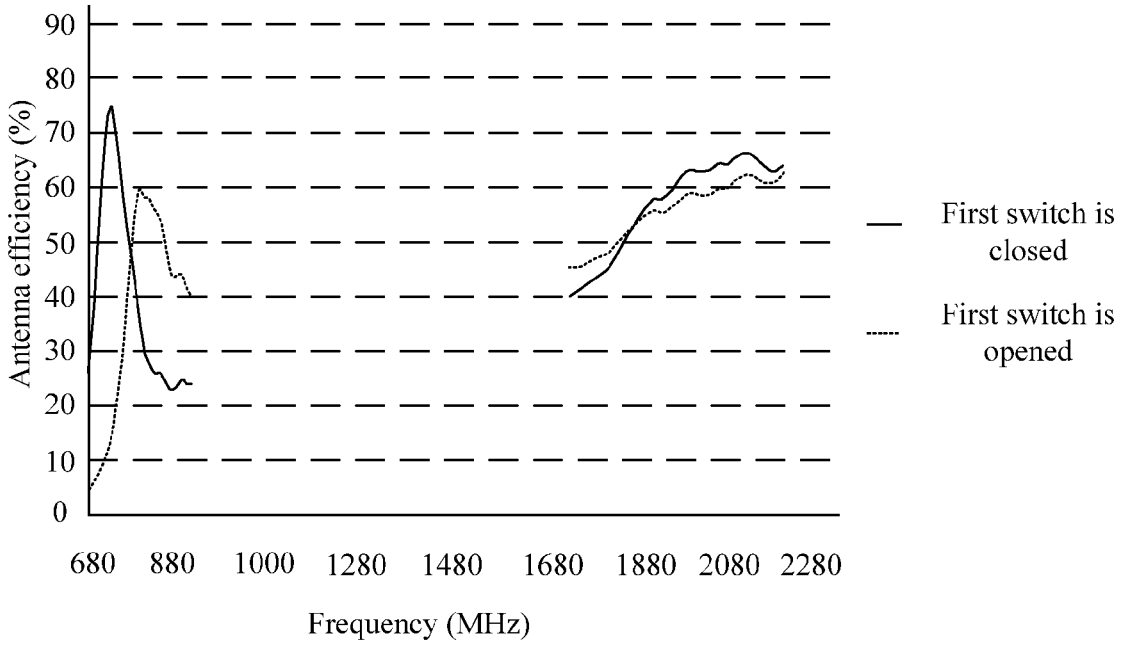
FIG. 5 is a schematic diagram of antenna efficiency according to an embodiment of the present disclosure.

The following describes efficiency of the antenna apparatus in this embodiment using an antenna structure to implement a LTE antenna as an example. An LTE antenna that uses the structure in this embodiment is double-low frequency antenna, and needs to implement switching between two frequency ranges, that is, 824-894 megahertz (MHz) and 699-746 MHz. When a first switch is opened, a resonance frequency of the LTE antenna is 700 MHz; when the first switch is closed, the resonance frequency of the LTE antenna is 850 MHz. A schematic diagram of antenna efficiency in FIG. 5 is obtained by performing an actual test. It can be seen from a test result that, when the first switch is opened, efficiency of the LTE antenna is above 50 percent (%) in a frequency range of 699-770 MHz; when the first switch is closed, efficiency of the LTE antenna is above 40% in a frequency range of 770-900 MHz, which effectively covers low-band bandwidth. In addition, it can be seen that, closing and opening of the first switch has a relatively small impact on antenna efficiency in a high frequency band.

It should be noted that, in this embodiment of the present disclosure, switching of an antenna between two resonance frequencies 700 MHz and 850 MHz is used as an example for description. It can be understood that, a resonance frequency of the antenna may be changed by changing the structure of the antenna, for example, changing a length of a arm, thereby implementing switching between other resonance frequencies by closing and opening of the foregoing first switch, which is not limited to implementation of switching between double-low frequencies, for example, switching between double-high frequencies may also be implemented.

According to the antenna apparatus in this embodiment of the present disclosure, a switch disposed at an end of an antenna arm controls whether the end of the antenna arm is grounded, so that an antenna switches to different resonance frequencies. The switch is disposed at the end of the antenna arm, and switch loss is not caused; therefore, antenna bandwidth is increased while reduced antenna efficiency caused by the switch loss is avoided, and space occupied by the antenna is not increased.

Embodiment 5

Figure 6:
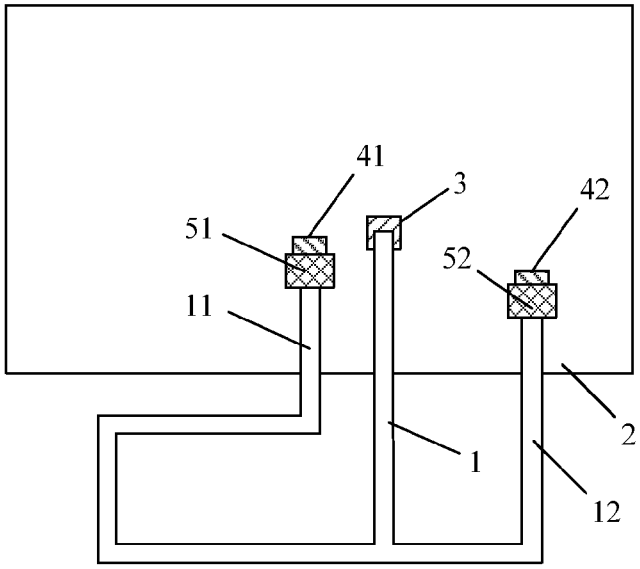
FIG. 6 is a schematic structural diagram of another antenna apparatus according to an embodiment of the present disclosure.

As shown in FIG. 6, Embodiment 5 is based on Embodiment 1, and the antenna apparatus further includes a second switch 52 and a second grounding point 42 that is disposed on the printed circuit board 2; the antenna 1 further includes a second arm 12, where an end of the second arm 12 is connected to the second grounding point 42 by the second switch 52. When the second switch 52 is closed, the end of the second arm 12 is connected to the second grounding point 42, so that the second arm 12 forms a loop arm; when the second switch 52 is opened, the end of the second arm 12 is floating. Other structures in the antenna apparatus are the same as those in Embodiment 1, and details are not described herein again.

Two switches, that is, the first switch 51 and the second switch 52, are respectively disposed at the end of the first arm 11 and at the end of the second arm 12, and each switch has two states, that is, closed and opened; therefore, an antenna having the two switches has the following four states In a first state, the first switch 51 and the second switch 52 are both closed, and the end of the first arm 11 and the end of the second arm 12 are both grounded; in this case, the antenna is equivalent to a double Loop antenna.

In a second state, the first switch 51 and the second switch 52 are both opened, and the end of the first arm 11 and the end of the second arm 12 are both floating; in this case, the antenna is equivalent to a Monopole antenna.

In a third state, the first switch 51 is closed, the end of the first arm 11 is grounded, the second switch 52 is opened, and the end of the second arm 12 is floating; in this case, the antenna is equivalent to a single-arm PIFA antenna.

In a fourth state, the first switch 51 is opened, the end of the first arm 11 is floating, the second switch 52 is closed, and the end of the second arm 12 is grounded; in this case, the antenna is equivalent to a single-arm PIFA antenna.

It should be noted that, although the four states include two types of single-arm PIFA antennas, because arm lengths of the two types of single-arm PIFA antennas are different, the antenna in the foregoing four states has different resonance frequencies, thereby any one of the four states may be implemented by controlling closing and opening of the first switch 51 and the second switch 52, that is, switching between two, three, or four resonance frequencies of the antenna can be implemented, and antenna bandwidth is increased.

According to the antenna apparatus in this embodiment of the present disclosure, a switch disposed at an end of an antenna arm controls whether the end of the antenna arm is grounded, so that an antenna switches to different resonance frequencies. The switch is disposed at the end of the antenna arm, and switch loss is not caused; therefore, antenna bandwidth is increased while reduced antenna efficiency caused by the switch loss is avoided, and space occupied by the antenna is not increased.

Embodiment 6

Figure 7:
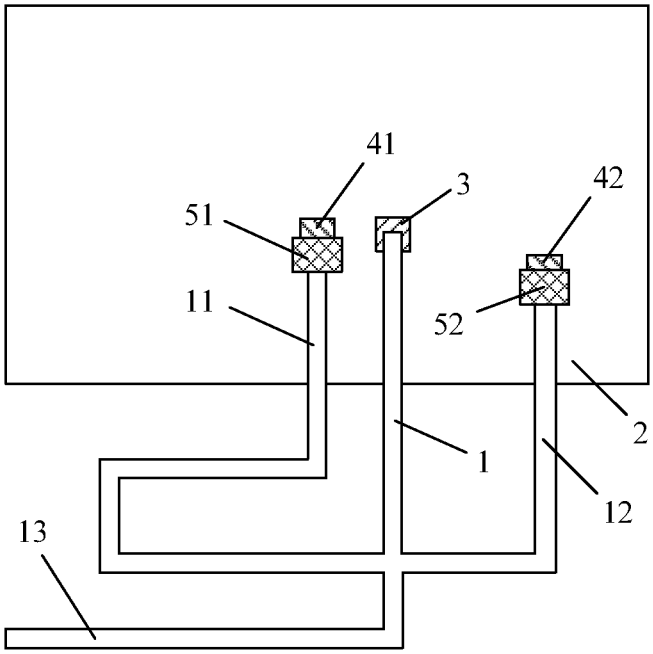
FIG. 7 is a schematic structural diagram of another antenna apparatus according to an embodiment of the present disclosure.

As shown in FIG. 7, Embodiment 6 is based on Embodiment 5, and the antenna further includes a third arm 13, where an end of the third arm 13 is floating. Other structures in the antenna apparatus are the same as those in Embodiment 5, and details are not described herein again.

Similarly, the antenna may be switched between the following four states by controlling closing and opening of the first switch 51 and the second switch 52.

In a first state, the first switch 51 and the second switch 52 are both closed, the end of the first arm 11 and the end of the second arm 12 are both grounded; in this case, the antenna is equivalent to a double Loop+high-frequency arm antenna.

In a second state, the first switch 51 and the second switch 52 are both opened, the end of the first arm 11 and the end of the second arm 12 are both floating; in this case, the antenna is equivalent to a Monopole antenna.

In a third state, the first switch 51 is closed, the end of the first arm 11 is grounded, the second switch 52 is opened, and the end of the second arm 12 is floating; in this case, the antenna is equivalent to a double-arm PIFA antenna.

In a fourth state, the first switch 51 is opened, the end of the first arm 11 is floating, the second switch 52 is closed, and the end of the second arm 12 is grounded; in this case, the antenna is equivalent to a double-arm PIFA antenna.

Similar to Embodiment 5, in the four states, a resonance frequency of the antenna in each state is different, switching between two, three, or four resonance frequencies of the antenna can be implemented, and antenna bandwidth is increased.

According to the antenna apparatus in this embodiment of the present disclosure, a switch disposed at an end of an antenna arm controls whether the end of the antenna arm is grounded, so that an antenna switches to different resonance frequencies. The switch is disposed at the end of the antenna arm, and switch loss is not caused; therefore, antenna bandwidth is increased while reduced antenna efficiency caused by the switch loss is avoided, and space occupied by the antenna is not increased.

Embodiment 7

Embodiment 7 of the present disclosure provides a terminal device, which includes any antenna apparatus in the foregoing embodiments, a radio frequency module connected to a feedpoint on a printed circuit board in the antenna apparatus, and a switch control module connected to a first switch or a first and a second switch in the antenna apparatus. Specific structures and principles of the antenna apparatus are the same as those in the foregoing embodiments, and details are not described herein again. The radio frequency module is configured to provide a transmit signal for an antenna using a feedpoint or obtain, using the feedpoint, a signal received by the antenna. The switch control module is configured to control closing and opening of the first switch or control closing and opening of the first switch and the second switch, so as to implement switching of the antenna between different resonance frequencies. Antenna apparatuses in Embodiment 1 to Embodiment 4 include only the first switch; therefore, switching of the antenna between two resonance frequencies may be implemented by controlling closing and opening of the first switch by the switch control module. Antenna apparatuses in Embodiment 5 and Embodiment 6 both include the first switch and the second switch; therefore, a switch control module needs to be connected to the first switch and the second switch, so as to implement control of the two switches, where an antenna having the two switches includes the following four states: the first switch and the second switch are both closed; the first switch and the second switch are both opened; the first switch is closed while the second switch is opened; the first switch is opened while the second switch is closed. In the four states, the antenna has different structures and resonance frequencies; for details, refer to Embodiment 5 and Embodiment 6, thereby implementing switching of the antenna between multiple resonance frequencies.

The foregoing terminal device may be a mobile phone, a data card, a fixed wireless terminal, a tablet computer, or the like.

According to the terminal device in this embodiment of the present disclosure, a switch disposed at an end of an antenna arm controls whether the end of the antenna arm is grounded, so that an antenna switches to different resonance frequencies. The switch is disposed at the end of the antenna arm, and switch loss is not caused; therefore, antenna bandwidth is increased while reduced antenna efficiency caused by the switch loss is avoided, and space occupied by the antenna is not increased.

The foregoing descriptions are merely specific implementation manners of the present disclosure, but are not intended to limit the protection scope of the present disclosure. Any variation or replacement readily figured out by a person skilled in the art within the technical scope disclosed in the present disclosure shall fall within the protection scope of the present disclosure. Therefore, the protection scope of the present disclosure shall be subject to the protection scope of the claims.

What is claimed is:

1. An antenna apparatus, comprising:

a printed circuit board, wherein a feedpoint and a first grounding point are disposed on the printed circuit board;

an antenna comprising a first arm, wherein the antenna is connected to the feedpoint; and a first switch, directly connected between an end of the first arm and the first grounding point, wherein when the first switch is closed, the end of the first arm is connected to the first grounding point, and wherein when the first switch is opened, the end of the first arm is floating; and wherein the antenna further comprises a second arm, and wherein an end of the second arm is grounded.

2. The antenna apparatus according to claim 1, wherein the antenna further comprises a third arm, and wherein an end of the third arm is floating.

3. The antenna apparatus according to claim 1, further comprising a second switch and a second grounding point disposed on the printed circuit board, wherein an end of the second arm is connected to the second grounding point by the second switch, wherein when the second switch is closed, the end of the second arm is connected to the second grounding point, and wherein when the second switch is opened, the end of the second arm is floating.

4. The antenna apparatus according to claim 3, wherein the antenna further comprises a third arm, and wherein an end of the third arm is floating.

5. The antenna apparatus according to claim 1, wherein the antenna further comprises an antenna arm that is disposed between the first arm and the second arm, and wherein the antenna arm is directly connected to the feedpoint.

6. A terminal device, comprising: an antenna apparatus comprising:

a printed circuit board, wherein a feedpoint and a first grounding point are disposed on the printed circuit board;

an antenna comprising a first arm, wherein the antenna is connected to the feedpoint;

a first switch directly connected between an end of the first arm and the first grounding point, wherein when the first switch is closed, the end of the first arm is connected to the first grounding point, and wherein when the first switch is opened, the end of the first arm is floating; a radio frequency module connected to the feedpoint on the printed circuit board in the antenna apparatus; and a switch control module connected to the first switch in the antenna apparatus in the antenna apparatus; and wherein the antenna further comprises a second arm, and wherein an end of the second arm is grounded.

7. The terminal device according to claim 6, wherein the antenna further comprises a third arm, and wherein an end of the third arm is floating.

8. The terminal device according to claim 6, wherein the terminal device is one of a mobile phone, a data card, a fixed wireless terminal, and a tablet computer.

9. The terminal device according to claim 6, wherein the antenna apparatus further comprises:

a second switch; and a second grounding point disposed on the printed circuit board, wherein an end of the second arm is connected to the second grounding point by the second switch, wherein when the second switch is closed, the end of the second arm is connected to the second grounding point, wherein when the second switch is opened, the end of the second arm is floating, and wherein the switch control module connected to the first switch and the second switch in the antenna apparatus.

10. The terminal device according to claim 9, wherein the antenna further comprises a third arm, and wherein an end of the third arm is floating.

11. The terminal device according to claim 9, wherein the terminal device is one of a mobile phone, a data card, a fixed wireless terminal, and a tablet computer.

12. The terminal device according to claim 9, wherein the antenna further comprises an antenna arm that is disposed between the first arm and the second arm, and wherein the antenna arm is directly connected to the feedpoint.

* * * * *